US005716688A

United States Patent [19]

Burke et al.

[11] Patent Number: 5,716,688

[45] Date of Patent: Feb. 10, 1998

[54] ENCLOSED PROMOTIONAL LABEL

[75] Inventors: Peter G. Burke, Gainesville; David M. Good, Peachtree City; Benny R. Rich, Oakwood; James J. Carides, Lawrenceville, all of Ga.

[73] Assignee: Dittler Brothers Incorporated, Atlanta, Ga.

[21] Appl. No.: 681,327

[22] Filed: Jul. 22, 1996

[51] Int. Cl.[6] ..... G09F 3/00

[52] U.S. Cl. ..... 428/43; 283/81; 283/94; 283/98; 283/101; 283/103; 283/105; 428/134; 428/138; 428/194

[58] Field of Search ..... 428/43, 40.1, 192, 428/134, 138; 283/81, 101, 103, 94, 98, 105

[56] References Cited

U.S. PATENT DOCUMENTS

| | | | |
|---|---|---|---|
| 3,900,219 | 8/1975 | D'Amato | 283/101 |
| 4,771,891 | 9/1988 | Sorensen | 283/103 |
| 5,011,190 | 4/1991 | Matsuguchi | 283/101 |
| 5,125,689 | 6/1992 | Heninger | 283/106 |
| 5,238,272 | 8/1993 | Taylor | 283/101 |
| 5,340,158 | 8/1994 | Barti | 283/101 |
| 5,403,636 | 4/1995 | Crum | 428/40.1 |
| 5,520,760 | 5/1996 | Freedman | 156/152 |

OTHER PUBLICATIONS

Rich, Benny R., et al., U.S.S.N. 08/514,298, Filed Aug. 11, 1995 *Multi-Ply Label.*

Rich, Benny, R., et al., U.S.S.N. 08/681,211, Filed Jul. 22, 1996 *Multi-Label Containing Removable Pieces.*

Copy of Sample McDonald's "Splash for Cash" Game Stamp (copyright 1988).

*Primary Examiner*—Nasser Ahmad

*Attorney, Agent, or Firm*—Dean W. Russell; Geoff L. Sutcliffe; Kilpatrick Stockton LLP

[57] ABSTRACT

A label comprised of at least two coupled plies is disclosed that can incorporate a removable game on the inside face of the centerpiece region of an outer ply. An edge region on the outer ply, which circumscribes the centerpiece region, is adhered to an inner ply. A weakened region separates the edge region from the centerpiece region so that the centerpiece region is removable from the label by first decoupling a segment of the centerpiece region from the edge region of the outer ply, and then grasping and pulling the centerpiece region from the label to decouple it completely from the label.

32 Claims, 3 Drawing Sheets

ENCLOSED PROMOTIONAL LABEL

FIELD OF THE INVENTION

This invention relates to multi-ply labels and more particularly to multi-ply labels that contain removable promotional game pieces.

BACKGROUND OF THE INVENTION

An existing label used in connection with promotional games includes two plies. One ply, forming the base of the label, has an underside to which a pressure-sensitive adhesive is affixed. The opposing side of the base, the face, contains no adhesive, and may be printed with promotional or other material. In use, the underside of the base is attached to a substrate such as a paper beverage cup sold in retail outlets.

The second ply, which similarly includes a face and an underside, overlays the base of the label. The second ply contains three parallel regions that extend along the length of the ply and are separated by two parallel rows of perforations. The underside of the outer two regions contains an adhesive that couples the underside of the second ply to the face of the base ply. Between the outer regions is an intermediate region. The game piece, which contains information concerning the prize to be awarded for a particular promotion, is printed on the underside of the intermediate region. The face of the second ply may have promotional information and game-playing instructions printed thereon.

To play the promotional game a player separates the intermediate region of the second ply from the outer regions by detaching it along the perforations. Doing so exposes the surface of the game piece containing the prize information and informs the player of the remit of the promotion.

Multi-ply labels present various security and handling problems. In particular, a game piece that is coupled with the label by adjacent and supporting portions may extend from the promotional label roughly in the form of a tab to permit a player more easily to detach the game piece from the label. In situations in which a label is applied to a pliable (as opposed to a rigid) surface, or where the game piece is comparatively large, it may become temptingly easy for a party to peek at the inner surface of the game piece by bowing or otherwise distorting the surrounding pliable material or the game piece. A mechanism to preclude manipulation of a label, a game piece, or a mounting surface to compromise the game is thus highly desirable.

To prevent tampering and premature viewing of a game releasable adhesives are typically employed to secure the plies together. An adhesive is often applied to one face of a ply along with a release coating that is applied to the opposing face of the adjacent ply. Depending upon the adhesive employed, degradation can cause the adhesive to lose its effect and allow the plies to separate prematurely. Some adhesives may harden and cause the plies to adhere permanently, requiring a player to tear the game piece in order to expose it. Plies secured together by a releasable adhesive are also prone to premature separation when, for instance, a ply is inadvertently snagged by a fixed object. Moreover, despite the adhesives players can still peek within the label by sliding a thin object between the plies and thereby separating them.

Releasable adhesives cause additional problems when one desires to manufacture a promotional label that incorporates a sticker as a third ply. Such stickers may be sandwiched between the base and outer plies of the label. In order to prevent premature peeking at the face of the sticker an adhesive and release coating may optionally be applied between the face of the sticker and the opposing ply. When this is done, however, some of the adhesive or release coating may remain bound to or discolor the sticker when removed from the label.

It is an object of this invention, therefore, to provide a label which incorporates a game piece that resists tampering and manipulation that compromises the game prematurely.

Another object of this invention is to provide a tamper-resistant label that incorporates a game piece that does not require adhesives to be applied between the face of the game piece and an opposing ply.

It is another object of this invention to provide a tamper-resistant label from which a game piece can be easily separated and removed without tearing or otherwise compromising the game piece.

It is a further object of this invention to provide a tamper-resistant promotional label having a removable sticker as a game piece;

Other objects, features and advantages will become apparent to people skilled in the art by reference to this specification and the drawings appended hereto.

SUMMARY OF THE INVENTION

In one embodiment of the present invention the label is comprised of two plies, a base ply that is adhered to a substrate such as a beverage cup, and a second ply, a portion of which is adhered to the base ply. The second ply is separable into four regions—a first edge, a second circumscribing edge, a strip, and a centerpiece. The four regions are defined by five rows of perforations that when torn allow the regions to be separated. The first edge traverses a segment of the peripheral boundary of the second ply. The second circumscribing edge traverses the bulk of the remaining peripheral boundary of the second ply. The edges are coupled securely to the base ply by a suitable adhesive. The third region, a strip, separates the two edges, lies adjacent to and along the length of the first edge, and traverses the length of the second ply. The fourth region, the centerpiece, is enclosed by and coupled to the strip and the second circumscribing edge.

The strip has a tab that extends generally beyond the outer periphery of the second ply. By grasping and pulling the tab one can tear the rows of perforations that couple the strip to the edges and the centerpiece and thereby separate the strip from the second ply. Separation of the strip from the second ply also decouples one edge of the centerpiece from the label, leaving the centerpiece coupled to the label only along the second circumscribing edge. A person can then grasp the decoupled edge of the centerpiece and pull the centerpiece away from the base ply by tearing the perforations that couple the centerpiece to the second circumscribing edge. The game piece, which may be printed on the underside of the centerpiece, is thereby exposed for viewing and can subsequently be removed from the label.

The present label may optionally comprise a third ply that is sandwiched between the base and second plies. Like the second ply, the third ply is separable into four regions along five rows of perforations. The four regions correspond to the regions of the second ply and approximate the geometry and size of the regions defined in the second ply. The underside of the third ply, which lies adjacent to the base ply, is adhered to the base ply at the first edge and second circumscribing edge of the third ply. The opposed face of the third ply, at the first edge, the second circumscribing edge, and the strip, are adhered to the underside of the second ply at its first edge, second circumscribing edge, and strip, respectively. By grasping and tearing the strips from the second and third plies a player can decouple one edge of the centerpiece regions of the second and third plies from the label. By grasping the exposed edges of the centerpiece regions and pulling the regions from the label one can separate and remove the centerpiece region from the label. The opposed face of the third ply in the centerpiece region may be adhered releasably to the inner face of the second ply so that when the centerpieces have been removed from the label the centerpiece of the third ply can be separated from the centerpiece of the second ply to liberate a game piece or sticker that can optionally be readhered to another surface.

DETAILED DESCRIPTION OF THE INVENTION

Figure 1:
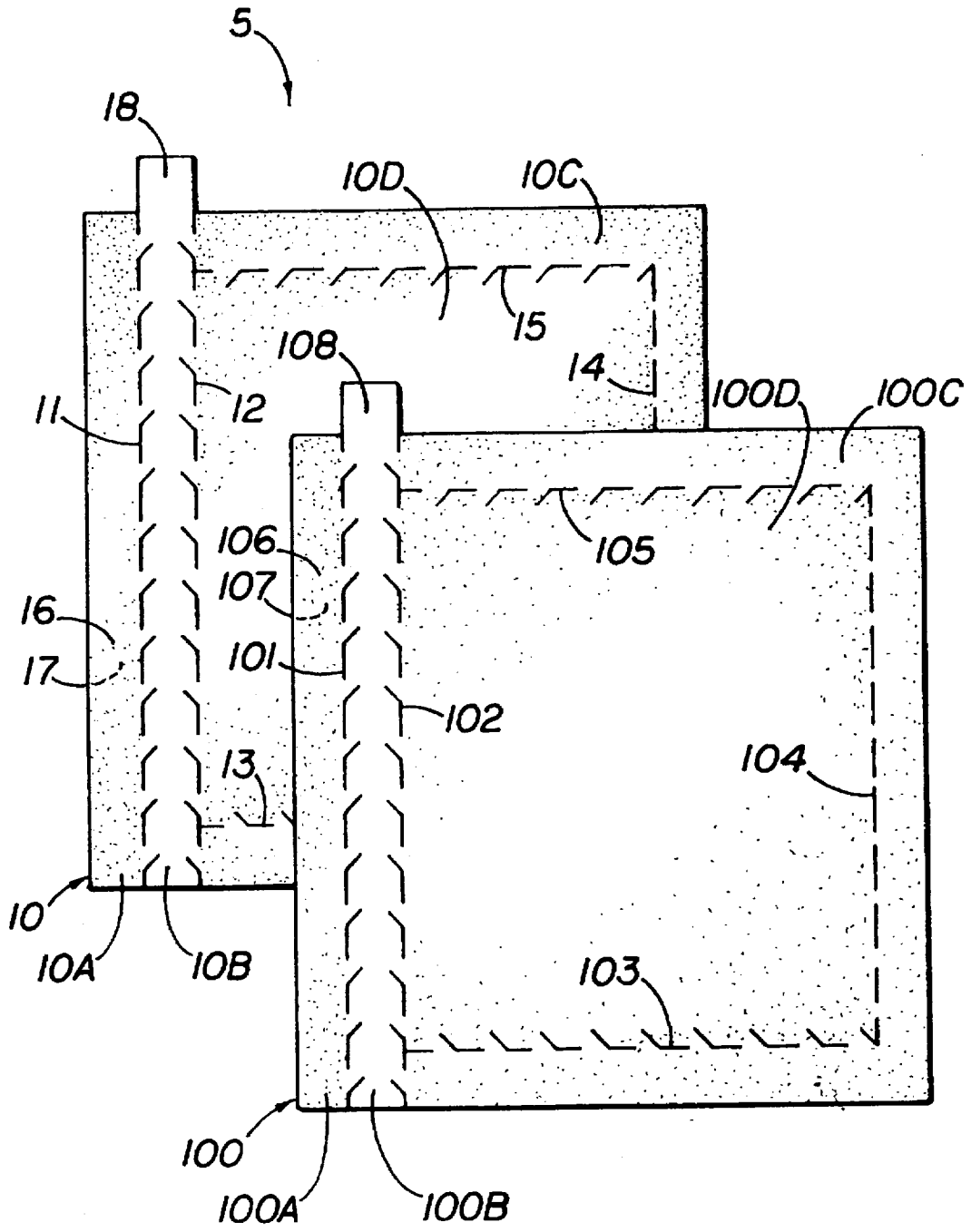
FIG. 1 is an exploded view of a two-ply label constructed according to one embodiment of the present invention, viewed from above.

One aspect of the present invention relates to the means by which a detachable game piece is coupled to and removed from a promotional label. A label construction is employed in which the periphery of a game piece is totally enclosed by the edges of the label to prevent anyone from viewing the underside of the game piece without first tearing the perforations that separate the game piece from the edges of the label. Referring particularly to FIG. 1 there is shown a label 5 from which a game piece cannot be removed without first tearing it from the edges that circumscribe the game piece.

FIG. 1 shows a label 5 in exploded view. A first or base ply 10 is formed of a material having sufficient strength to bear additional plies, to anchor those plies to a substrate surface (not shown), and to retain portions of the label 5 even upon manual removal of other portions. Base ply 10 has a face 16 and an underside 17. Underside 17 is provided with an adhesive of sufficient strength to retain it and any attached plies to a temporary holding surface (from which label 5 is eventually to be removed) and ultimately to a substrate, such as a soft drink cup, food wrapper, or other such product.

In the embodiment illustrated in FIG. 1 ply 10 includes four portions: a first edge 10A, a strip 10B, a second circumscribing edge 10C, and a centerpiece 10D. These potions are delineated from adjacent portions by weakened regions such as perforation rows 11, 12, 13, 14 and 15. Strip 10B is distinguished and manually separable from first edge 10A by perforation row 11. Strip 10B is distinguished and manually separable from centerpiece 10D and second circumscribing edge 10C by perforation row 12. Centerpiece 10D is distinguished and manually separable from strip 10B by perforation row 12, and from second circumscribing edge 10C by perforation rows 13, 14, and 15. In one embodiment the illustrated regions, perforations and separability in base ply 10 are optional because the base ply, once applied, typically need not be separated into component parts.

The geometry of the periphery of the label shown in FIG. 1 has certain features that are important to the functioning of the disclosed embodiment. In particular, the strip portion 10B of base ply 10 has a periphery that physically and visually distinguishes it from the remainder of label 5. In FIG. 1 the distinguishable periphery is a tab 18 of base ply 10 that protrudes beyond the periphery of the label at the intersection of the strip 10B with edge regions 10A and 10C.

As further shown in FIG. 1 label 5 may comprise a second ply 100. The size and geometry of ply 100 is advantageously similar to that of base ply 10. Ply 100, like ply 10, includes a face 106 and an underside 107. Ply 100 also is comprised of four portions—100A, 100B, 100C, and 100D. As is the case with the portions of ply 10, portions 100A and 100B are distinguished and separable from one another along perforation row 101, portion 100B is distinguished and separable from portions 100C and 100D along perforation row 102, and portions 100C and 100D are distinguished and separable along perforation rows 103, 104, and 105. When ply 100 is laid over ply 10, portions 100A, 100B, 100C and 100D, and rows 101, 102, 103, 104, and 105, generally overlay and correspond to their respective portion or row in ply 10. A tab 108 of strip 100B protrudes beyond adjacent edges of portions 100A and 100C and overlies tab 18. Although the geometry of ply 100 may correspond to that of ply 10, the invention is limited neither to this particular geometry nor to strict correspondence between all dimensions of the plies or the regions of which the plies are comprised.

Centerpiece 100D may contain a game piece that has been incorporated on the underside 107 of centerpiece 100D by printing the underside 107 with game indicia. Opposed face 106 of ply 100 may also be printed with promotional information and game-related information because this is the surface to which consumers will be exposed prior to playing the game. The printing of the underside and face of the game piece may occur before plies 10 and 100 are assembled into a functional promotional label.

In order to assemble plies 10 and 100 into a functional promotional label 5 the underside 107 of ply 100 at first edge 100A and second circumscribing edge 100C is coupled by suitable means to face 16 of ply 10 at first edge 10A and second circumscribing edge 10C. This coupling is preferably achieved by a known adhesive having sufficient strength to hold the first edges and second circumscribing edges of plies 10 and 100 together while strip 100B is being torn from the label 5 along perforation rows 101 and 102, and while centerpiece 100D is being torn from the label 5 along perforation rows 103, 104, and 105.

When label 5 has been assembled as described, and when the entire underside 17 of ply 10 has been adhered to a substrate, only tab 108 can be grasped and pulled readily. Because strip 100B is not adhered to the base ply, a player can grasp and pull tab 108, tear perforation rows 101 and 102, separate strip 100B from the label, and leave the remainder of the label intact. Once the strip 100B has been removed the game piece, which is contained on the underside of centerpiece 100D, can be grasped, pulled, and torn from label 5 along perforation rows 103 and 105, whereupon a player can rotate the game piece about perforation row 104. The game piece can then remain coupled to the label or, if preferred, centerpiece 100D can be again grasped and pulled in order to tear perforation row 104 and separate the game piece from the label 5.

The adhesion between the second circumscribing region and the base ply can be manipulated to improve the ease with which the centerpiece region 100D can be grasped after the strip 100B has been removed from the label. If, for instance, the second circumscribing edge 100C is adhered to the base ply 10 along its entire underside, and particularly at the points where the second circumscribing edge 100C meets the strip 100B, it may be difficult to lift and grasp centerpiece region 100D after strip 100B has been removed. Accordingly, adhesive may be omitted advantageously from beneath the circumscribing edge 100C in an area nearest either of the junctions between the circumscribing edge 100C and strip 100B, so that centerpiece region 100D can be lifted for grasping before it is torn from the circumscribing edge 100C.

Figure 3:
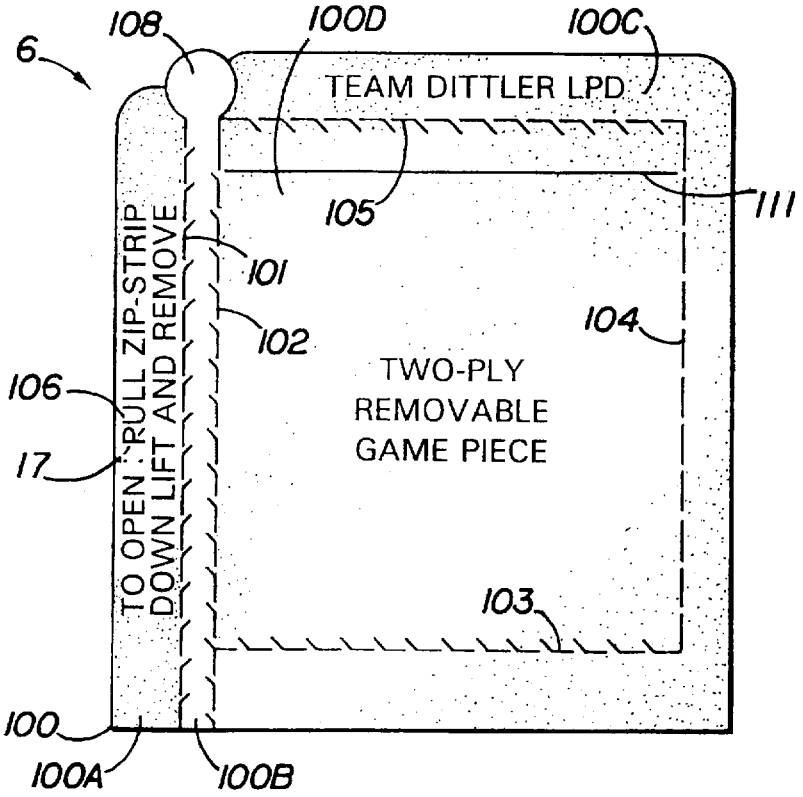
FIG. 3 is a top plan view of a label constructed according to the present invention showing the regions of the outermost ply, the perforations that separate the regions, and an optional score in the outermost ply.
Figure 4:
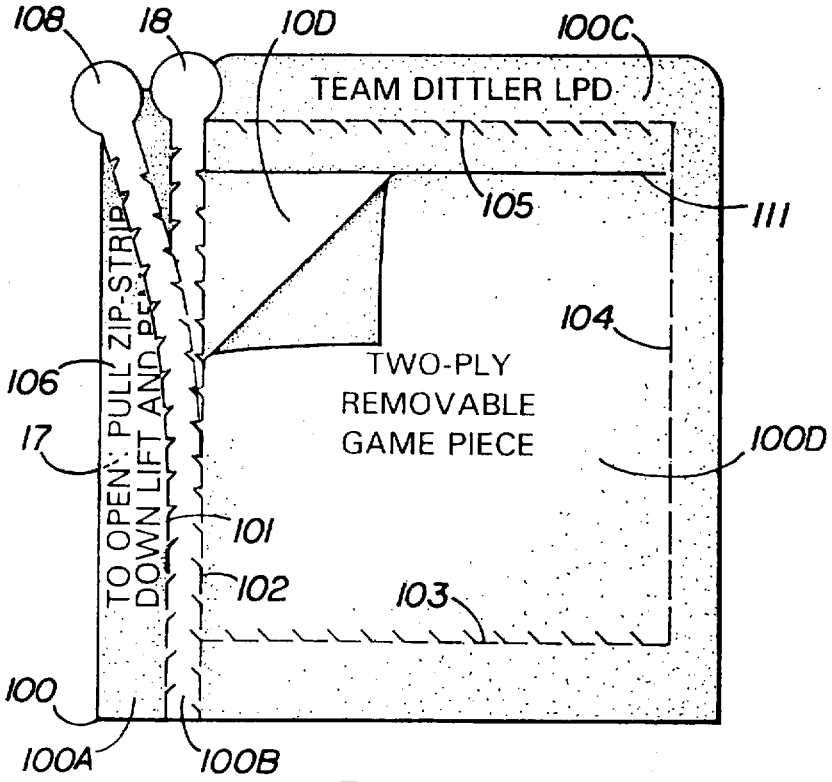
FIG. 4 is a top plan view of the label shown in FIG. 3 from which the strip and the centerpiece of the outermost ply have been partially removed to illustrate the function of the label.

The removal of strip 100B may be facilitated by the geometry of the perforations that form rows 101 and 102, as shown in FIGS. 3 and 4. The perforations in rows 101 and 102 may extend inwardly as "crow's feet" from the rows of perforations so that the perforations will engage more easily when the strip 100B is being removed and rows 101 and 102 are being torn. Similar inwardly extending perforations may also comprise perforation rows 103 and 105, which likewise assist engagement of perforations when centerpiece 100D is being removed and rows 103 and 105 are being torn. These inwardly extending perforations are generally desirable in labels constructed to require that two rows of perforations be torn at once, because it is difficult to ensure that the perforations in both rows engage continuously as the rows are torn simultaneously. These inwardly extending perforations are desirable in such a construction even though they may leave the edges of the game piece frayed once the game piece is removed.

Unidirectional perforations, which tear more cleanly than crow's feet, are generally preferred over crow's feet perforations where perforation rows readily tear. Perforation row 104 for instance, as shown in FIGS. 3 and 4, will tear readily because it is not torn at the same time as another row. Perforation row 104, accordingly, may omit crow's feet perforations and be comprised instead entirely of unidirectional perforations.

The cut-to-tie ratio, which is the length of perforations to the length between perforations in a segment for a row of perforations, can also be manipulated to facilitate tearing along a row of perforations, or to inhibit premature or accidental tearing of the perforation rows in a label. The cut-to-tie ratio can be varied, for instance, along the length of a row of perforations so that the segments in the row of perforations that have a high cut-to-tie ratio are more easily torn than other segments that have a low cut-to-tie ratio. Accordingly, in one embodiment of the present invention the cut-to-tie ratio of rows 101 and 102 is greatest in the middle of the rows of perforations in order to minimize the risk of accidental or premature rupture of perforations at the ends of the rows.

According to the foregoing construction there is achieved a label in which a game piece is totally enclosed and from which the game piece can be removed readily. The removable strip of the disclosed embodiment initiates the removal of the game piece from the label by allowing one to decouple the game piece from one of the edges of the label, thereby freeing one edge of the game piece so that it may be grasped and pulled away from the label to separate it from the label along existing perforations. It will be apparent to those skilled in the art that a game piece that is coupled to a label around its entire periphery can be decoupled from a first edge of the label by means other than a removable strip and removed from the label by means other than torn perforations. One such means would be a string that is mounted between plies at the juncture of the game piece to the label that, when pulled, would tear through the second ply and decouple the game piece from the label at one edge. The present invention is meant to encompass all means by which a game piece can be decoupled from the edges of a label in order to remove the game piece from the label.

Moreover, while the foregoing discussion has focused upon a particular label as shown and described, the invention does not depend on any particular geometry. Labels may take any number of external shapes or dimensions and still be within the scope of this invention as long as they are consistent with the principles set forth in this specification.

Figure 2:
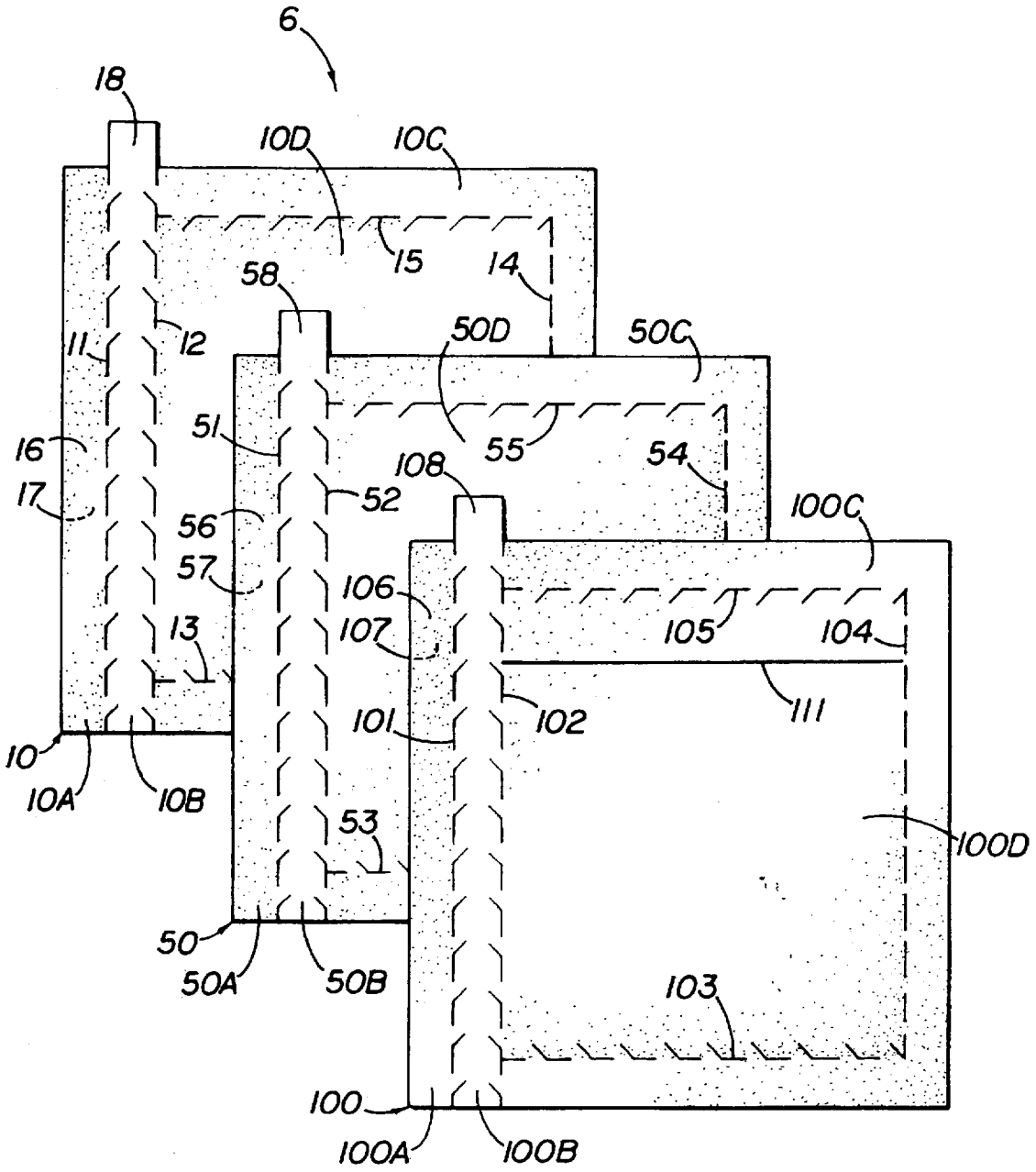
FIG. 2 is an exploded view of a three-ply label constructed according to another embodiment of the present invention, viewed from above.

A further embodiment of the present invention, label 6, is disclosed by FIG. 2 in which a third ply 50 is shown sandwiched between plies 10 and 100. The third ply 50 shown in FIG. 2 corresponds generally in size and geometry to plies 10 and 100. The third ply 50 is shown further to comprise four sections, 50A, 50B, 50C, and 50D, that correspond to and lie adjacent to respective sections 10A, 10B, 10C, and 10D of ply 10, and sections 100A, 100B, 100C, and 100D of ply 100, when ply 50 is laid over ply 10 and ply 100 is laid over ply 50.

Ply 50 is shown to have an underside 57 and opposed face 56. The underside 57 of ply 50 at edge regions 50A and 50C is adhered to the opposed face 16 of ply 10 at edge regions 10A and 10C. The opposed face 56 of ply 50, at edge regions 50A and 50C, is similarly adhered to the underside 107 of ply 100 at edge regions 100A and 100C. Edge regions 100A and 100C thereby remain secured to base ply 10, as disclosed herein in a separate embodiment, despite the presence of a third ply between the two plies.

The opposed face of the third ply at strip region 50B may be adhered to the underside of the second ply at strip 100B, depending upon the game construction that is desired. If strips 100B and 50B are adhered together then they can be removed from the label at one time, which would enable a player of the game to grasp and remove centerpiece regions 50D and 100D both at once. It may be particularly advantageous to adhere strips 50B and 100B together if centerpiece regions 50D and 100D cooperate to form a game piece. This advantage can be realized when, for instance, the opposed face 56 of ply 50 at centerpiece region 50D is a sticker adhered releasably to the underside 107 of ply 100 at centerpiece region 50D.

When centerpiece region 50D is a sticker or other object that is adhered releasably to centerpiece 100D a score 111 as illustrated in FIG. 2 may advantageously be cut through the centerpiece region 100D to permit centerpiece 100D to be folded along the score in order to facilitate separation of the centerpiece 50D from centerpiece 100D.

The foregoing is provided for purposes of illustrating, explaining, and describing embodiments of the present invention. Modifications and adaptations to theses embodiments will be apparent to those skilled in the art and may be made without departing from the scope and spirit of this invention.

What is claimed is:

1. A label comprising:

a. a base ply comprising:

i. an underside suitable for adhesion to a substrate; and ii. an opposed face;

b. a second ply comprising:

i. a centerpiece region having an underside, an opposed face, and an outer periphery;

ii. an edge region comprising:

A. an underside at least partially secured to the opposed face of the base ply; and B. a segmented inner circuit releasably coupled to the outer periphery of the centerpiece region;

c. means, extending from one side of the second ply to an opposite side, for decoupling a segment of the inner circuit of the edge region of the second ply from the centerpiece region of the second ply: and d. an adhesive applied to the underside of the base ply for attaching the base ply to the substrate.

2. The label of claim 1 wherein the means for decoupling comprises a first strip that can be removed from the label which is defined by first and second parallel rows of perforations that traverse the edge region of the second ply, the first parallel row abutting the centerpiece region.

3. The label of claim 2 further comprising a third row of perforations along which the inner circuit of the second ply is releasably coupled to the outer periphery of the centerpiece region of the second ply.

4. The label of claim 3 wherein the third row is comprised of first, second, and third segments, and wherein the first segment is parallel to the first strip and comprised of perforations that extend in the same direction along a straight line.

5. The label of claim 4 wherein the second and third segments are parallel and comprised of perforations that extend toward the centerpiece region.

6. The label of claim 2 wherein a ratio of the length of perforations to the length of spacing between perforations varies along at least one of the first and second rows of perforations.

7. The label of claim 6 wherein the ratio is greatest in the middle of at least one of the first and second rows of perforations.

8. The label of claim 2 wherein the first row is comprised of perforations that extend toward the second row of perforations, and wherein the second row is comprised of perforations that extend toward the first row of perforations.

9. The label of claim 2 wherein a portion of the first strip extends generally beyond an outer periphery of the second ply in the form of a tab.

10. The label of claim 2 wherein the underside of the edge region of the second ply is not secured to the opposed face of the base ply at a point where the edge region is near both the strip and the centerpiece region.

11. The label of claim 1 further comprising:

a. a third ply comprised of:

i. a centerpiece region having an underside, an opposed face, and an outer periphery; and ii. an edge region comprising:

A. an underside secured to the opposed face of the base ply;

B. an opposed face secured to the underside of the edge region of the second ply; and C. a segmented inner circuit releasably coupled to the outer periphery of the centerpiece region of the third ply; and b. means for decoupling a segment of the inner circuit of the edge region of the third ply from the outer periphery of the centerpiece region of the third ply while decoupling an adjacent segment of the inner circuit of the edge region of the second ply from the centerpiece region of the second ply.

12. The label of claim 11 wherein the means for decoupling a segment of the inner circuit of the edge region of the third ply comprises a second strip that can be removed from the label which is defined by third and fourth parallel rows of perforations that traverse the edge region of the third ply, the third parallel row abutting the centerpiece region of the second ply.

13. The label of claim 11 wherein the opposed face of the centerpiece region of the third ply is releasably adhered to the underside of the centerpiece region of the second ply.

14. The label of claim 13 further comprising a score that transects the centerpiece region of the second ply.

15. The label as set forth in claim 1, further comprising a second adhesive between the edge region of the second ply and the base ply.

16. A label, comprising:

a first ply for attachment to a substrate, the first ply including a first underside for attachment to the substrate and a first face opposing the first underside; and a second ply for attachment to the first ply, the second ply including:

a center region having a second underside and a second face opposing the second underside, the second face and the second underside forming an outer periphery; and an edge region formed adjacent to the outer periphery completely around the center region, the edge region being secured to the first ply and including a tear strip detachably coupled to the center region and an adhesive applied to the first underside of the first ply for attaching the first ply to the substrate;

wherein the tear strip of the edge region extends from one side of the second ply to an opposite side of the second ply.

17. The label as set forth in claim 16, wherein the strip is separated from the center region by at least one row of perforations.

18. The label as set forth in claim 17, wherein the edge portion includes a segment on an opposite side of the strip as the center region, the strip being separated from the segment by a second row of perforations.

19. The label as set forth in claim 16, wherein the strip includes a tab extending beyond the one side of the second ply.

20. The label as set forth in claim 16, wherein the edge portion is not secured to the first ply in areas near the outer periphery of the center region.

21. The label as set forth in claim 16, wherein the center region of the second ply is scored into at least two areas.

22. The label as set forth in claim 16, wherein the first ply comprises a second center region and a second edge region, the second center region having dimensions substantially equal to dimensions of the center region of the first ply and the second edge region having dimensions substantially equal to dimensions of the edge region of the first ply.

23. The label as set forth in claim 1, further comprising a third ply for being secured between the first ply and the second ply.

24. The label as set forth in claim 23, wherein the third ply includes a second center region and a second edge region, the second edge region being secured to both the edge region of the second ply and to the first ply.

25. The label as set forth in claim 24, the second center region having dimensions substantially equal to dimensions of the center region of the first ply and the second edge region having dimensions substantially equal to dimensions of the edge region of the first ply.

26. The label as set forth in claim 24, wherein the second center region of the third ply is releasably secured to the center region of the second ply.

27. The label as set forth in claim 23, wherein the second edge region is formed completely around the center region of the third ply and includes a second strip detachably coupled to the second center region of the third ply.

28. The label as set forth in claim 27, wherein the second strip of the third ply extends from one side of the third ply to an opposite side of the third ply.

29. The label as set forth in claim 16, further comprising a second adhesive limited to a region between the edge region of the second ply and the first ply.

30. The label as set forth in claim 16, wherein the second underside of the second ply includes printed matter.

31. The label as set forth in claim 23, wherein the second center region of the third ply includes printed matter.

32. The label as set forth in claim 31, wherein the printed matter is located on an upper surface of the third ply.

* * * * *